US005184361A

United States Patent [19]

Canter et al.

[11] Patent Number: 5,184,361

[45] Date of Patent: Feb. 9, 1993

[54] SLEEPING BAG STORAGE APPARATUS

[76] Inventors: Marylee Canter; Wilma Hulquist, both of P.O. Box 1647, Newport, Wash. 99156-1647

[21] Appl. No.: 874,437

[22] Filed: Apr. 27, 1992

[51] Int. Cl.[5] ..... A47G 9/08

[52] U.S. Cl. ..... 5/413; 5/658; 5/417

[58] Field of Search ..... 5/413, 416–420, 5/488, 658; 2/67.5

[56] References Cited

U.S. PATENT DOCUMENTS 3,798,686 3/1974 Gaiser ..... 5/413
3,877,092 4/1975 Gaiser ..... 5/413
4,222,468 9/1980 De Fries ..... 5/417 X
4,970,741 11/1990 Spina ..... 5/419 X
4,977,633 12/1980 Chaffee ..... 5/420 X

*Primary Examiner*—Michael F. Trettel
*Attorney, Agent, or Firm*—Leon Gilden

[57] ABSTRACT

An elongate rigid tubular member is arranged for securement adjacent an end portion of a sleeping bag, to include an elastomeric strap arranged to receive the sleeping bag between the strap and the tube. Rolling of the tube as a central core relative to the sleeping bag effects compact packaging of the sleeping bag for subsequent use.

4 Claims, 4 Drawing Sheets

SLEEPING BAG STORAGE APPARATUS

BACKGROUND OF THE INVENTION

1. Field of the Invention

The field of invention relates to sleeping bag apparatus, and more particularly pertains to a new and improved sleeping bag storage apparatus wherein the same is arranged for the easy furling of a sleeping bag for its storage and transport.

2. Description of the Prior Art

Sleeping bags of various types are typically utilized at infrequent times and spend a great deal of their effective life in storage. Typically, sleeping bags in the prior art, due to their bulky and extensive nature, take up an inordinate amount of room relative to their size. In an effort to overcome deficiencies of the prior art, the instant invention is addressed to provide for a spinal rib member arranged for selective temporary or permanent mounting relative to a sleeping bag to permit ease of furling for storage and the like. Prior art sleeping bags and their storage is addressed in U.S. Pat. No. 4,466,124 to Kirkham, Jr. setting forth an elongate backpack structure arranged for containment of a sleeping bag therewithin.

U S. Pat. No. 4,575,876 to Weaver sets forth a jacket formed with a self-contained sleeping bag therewithin.

As such, it may be appreciated that there continues to be a need for a new and improved sleeping bag storage apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of sleeping bag apparatus now present in the prior art, the present invention provides a sleeping bag storage apparatus wherein the same utilizes an elongate tube to curl a sleeping bag thereabout for its transport and storage. As such, the general purpose of the present invention, which will be described subsequently in greater detail, is to provide a new and improved sleeping bag storage apparatus which has all the advantages of the prior art sleeping bag apparatus and none of the disadvantages.

To attain this, the present invention provides an elongate rigid tubular member arranged for securement adjacent an end portion of a sleeping bag, to include an elastomeric strap arranged to receive the sleeping bag between the strap and the tube. Rolling of the tube as a central core relative to the sleeping bag effects compact packaging of the sleeping bag for subsequent use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sleeping bag storage apparatus which has all the advantages of the prior art sleeping bag apparatus and none of the disadvantages.

It is another object of the present invention to provide a new and improved sleeping bag storage apparatus which may be easily and efficiently manufactured and marketed.

It is a further object of the present invention to provide a new and improved sleeping bag storage apparatus which is of a durable and reliable construction.

An even further object of the present invention is to provide a new and improved sleeping bag storage apparatus which is susceptible of a low cost of manufacture with regard to both materials and labor, and which accordingly is then susceptible of low prices of sale to the consuming public, thereby making such sleeping bag storage apparatus economically available to the buying public.

Still yet another object of the present invention is to provide a new and improved sleeping bag storage apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
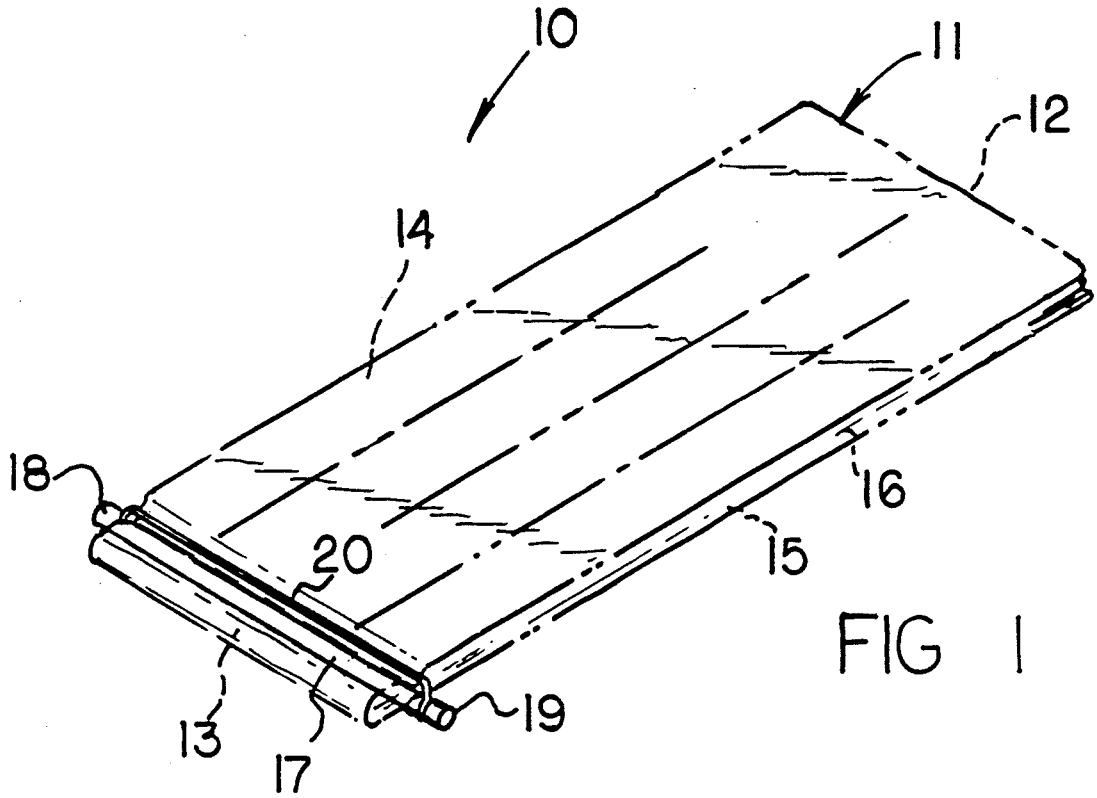
FIG. 1 is an isometric illustration of the instant invention relative to a sleeping bag.
Figure 2:
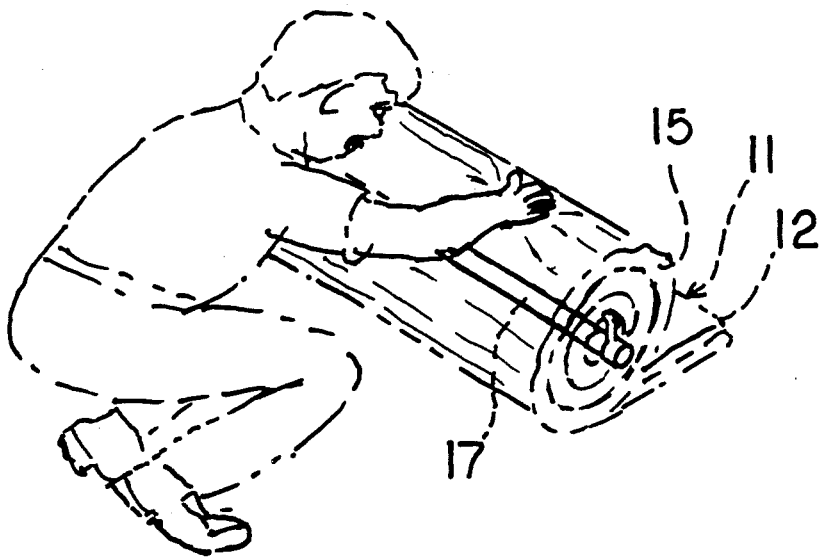
FIG. 2 is an isometric illustration of the invention with a sleeping bag furled thereabout.
Figure 3:
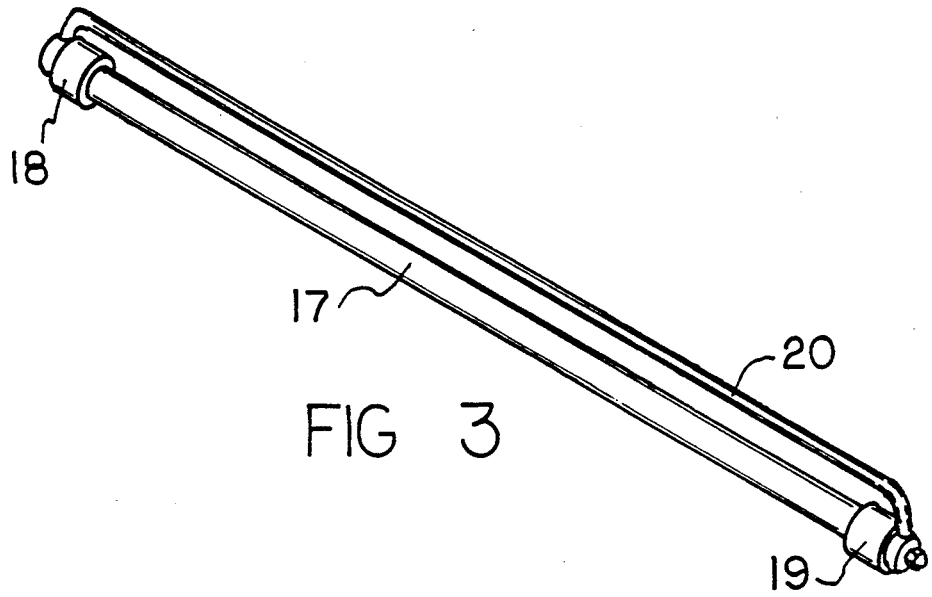
FIG. 3 is an isometric illustration of the invention.
Figure 4:
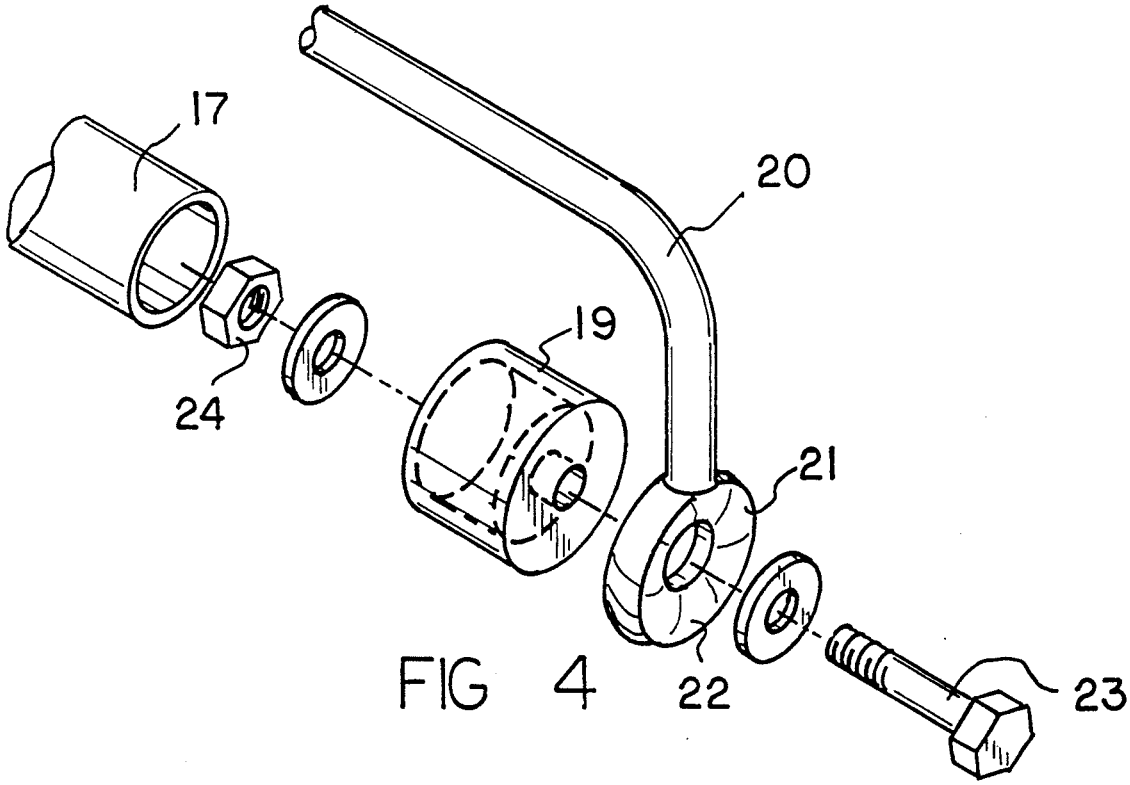
FIG. 4 is an isometric enlarged exploded view of mounting of the elastomeric strap relative to the tubular structure.

With reference now to the drawings, and in particular to FIGS. 1 to 8 thereof, a new and improved sleeping bag storage apparatus embodying the principles and concepts of the present invention and generally designated by the reference numeral 10 will be described.

More specifically, the sleeping bag storage apparatus 10 of the instant invention essentially comprises mounting to an associated elongate sleeping bag 11 of conventional construction, including a sleeping bag first end 12 spaced from a sleeping bag second end 13, with the sleeping bag first and second sides 14 and 15 with at least one fastener or zipper member 16 extending along the second side 15 and the first end 12, and optionally as manufacturing dictates, along the first side 14 if desired to provide for an enclosure to receive individuals therewithin.

A rigid tube member 17 (see FIG. 3) includes a first end cap 18 spaced from a second end cap 19 mounted to respective first and second ends of the tube member 17. An elastomeric strap 20 is mounted at the strap's first end to the first end cap 18 and the cap second end to the second end cap 19. The first and second ends of the strap 20 (see FIG. 4) include a strap ring 21 formed with a strap ring aperture 22 receiving a fastener rod 23 therethrough, with a fastener nut 24 positioned interiorly of an associated cap for pivotally mounting the strap 20 relative to the end cap. In this manner, the sleeping bag is directed between the elastomeric strap and the rigid tube for its securement adjacent the second end 13 of the sleeping bag to permit its subseguent furling, in a manner as set forth in FIG. 2, for a compact construction of the sleeping bag during periods of non-use. Alternatively if desired, the rigid tube may be fixedly secured adjacent the second end 13 for permanent attachment to the sleeping bag structure or maintained in a manner as illustrated in FIG. 1 for subsequent use.

Figure 5:
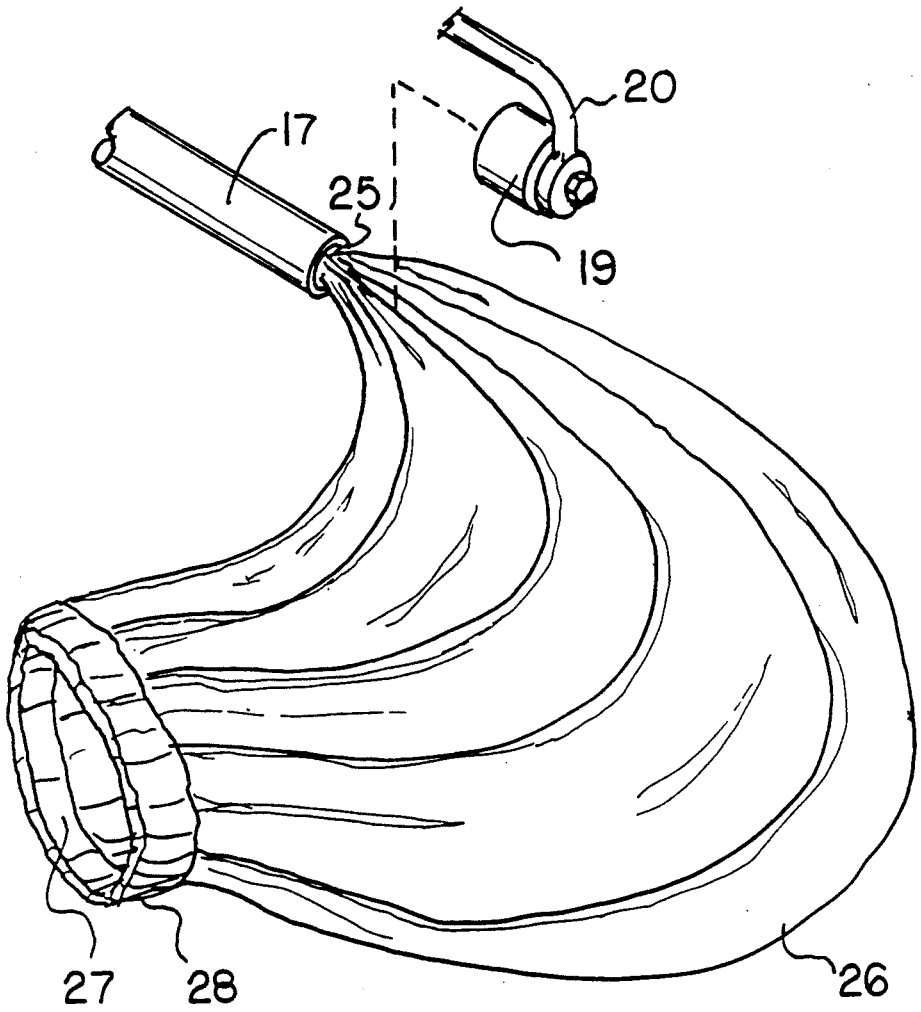
FIG. 5 is an isometric illustration of the invention utilizing a self-contained storage bag therewithin.
Figure 6:
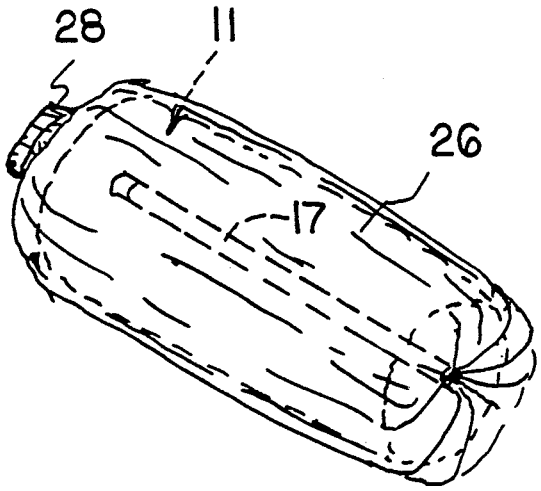
FIG. 6 is an isometric illustration of the invention illustrating the storage bag in surrounding relationship relative to an associated sleeping bag.

The FIG. 5 illustrates the organization to further include a tube member cavity 25 within the elongate rigid tube member 17 that is of a generally cylindrical configuration. The tube member cavity 25 stores a flexible bag member 26, typically of fluid impermeable material, including a bag member opening 27 at a bag member first end, with the bag member opening 27 formed within an elastomeric ring 28 to effect the gathering of the first end when secured about the associated sleeping bag 11, in a manner as illustrated in FIG. 6. The second end of the sleeping bag is secured within the rigid tube member 17 spaced from the second end cap 19.

Figure 7:
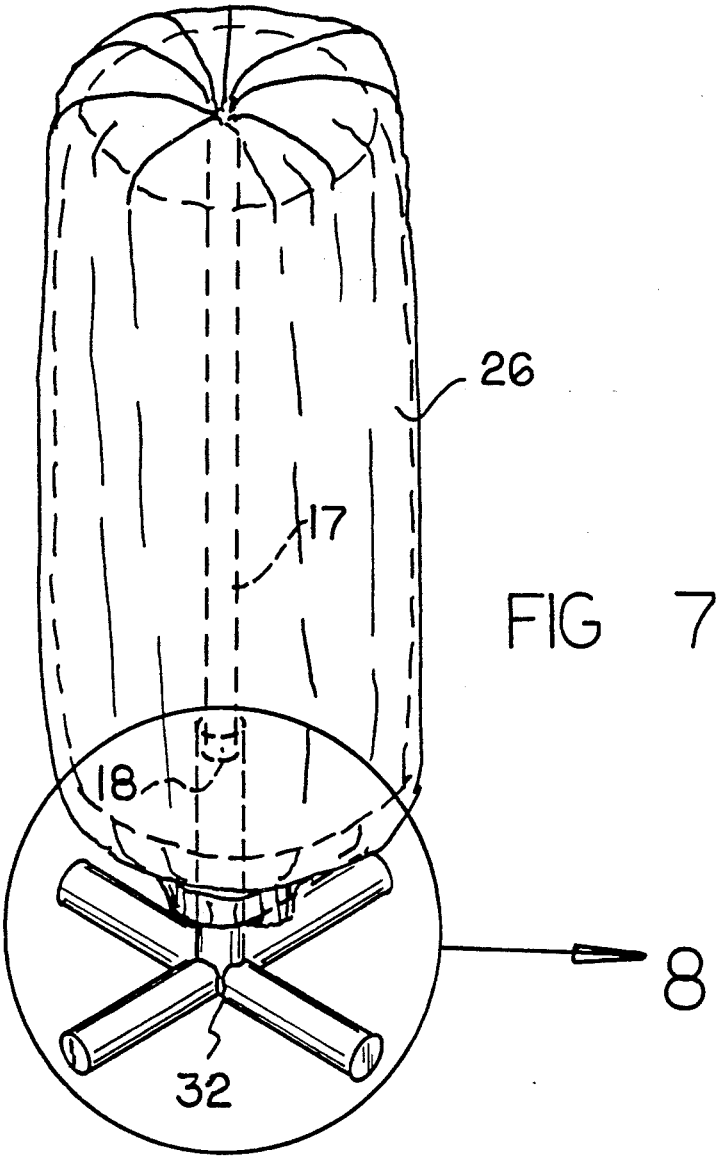
FIG. 7 is an isometric illustration of the invention utilizing a support stand.
Figure 8:
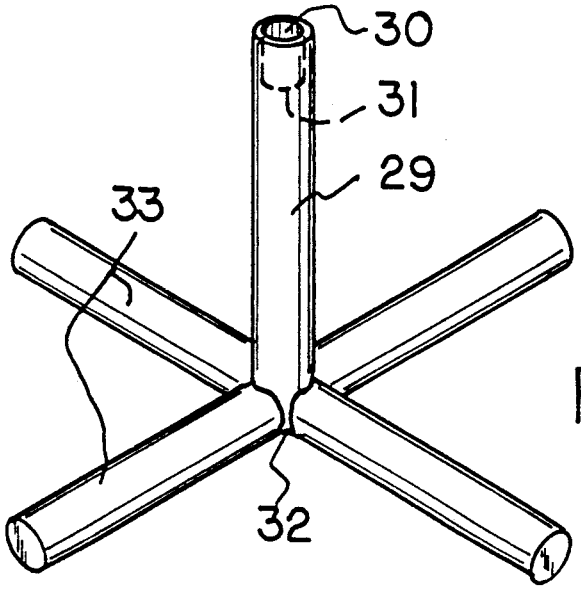
FIG. 8 is an enlarged isometric illustration of the support stand as set forth in section 8 of FIG. 7.

Further, a storage rack, as set forth in FIGS. 7 and 8, may be provided to include a support tube 29 formed within a tube receiving socket 30 at its upper distal end, with the tube receiving socket 30 including a socket bottom wall 31 receiving the first end cap 18 on the socket bottom wall 31 within the socket 30. The support tube includes a lower distal end 32, including a plurality of support legs 33 arranged in a radially projecting manner relative to the support tube orthogonally oriented relative to the support tube 29 at its lower distal end for ease of storage of the sleeping bag.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sleeping bag storage apparatus, comprising, an elongate sleeping bag, the elongate sleeping bag including a sleeping bag first end spaced from a sleeping bag second end, and a sleeping bag first side spaced from a sleeping bag second side, and a rigid tubular member mounted to the sleeping bag adjacent the sleeping bag second end parallel to the sleeping bag second end, with the rigid tube member including a first end cap mounted to a first end of the tube member, and a second end cap mounted to the second end of the tube member, and an elastomeric strap extending from the first end cap to the second end cap, and the sleeping bag received between the elastomeric strap and the tube member.

2. An apparatus as set forth in claim 1 wherein the elastomeric strap includes a strap first end and a strap second end, the strap first end secured to the first end cap, the strap second end secured to the second end cap, each strap end including a ring member, each ring member including a ring aperture directed therethrough, and a fastener rod directed through each aperture, with one of said each fastener directed through the first end cap and a further one of each fastener directed through the second end cap to pivotally mount the strap first end and the strap second end pivotally relative to the first end cap and the second end cap.

3. An apparatus as set forth in claim 2 wherein the tube member includes a tube member cavity directed between the first end cap and the second end cap, and the second end cap is removably mounted relative to the tube member second end, and a flexible bag member mounted within the tube member cavity, the flexible bag member including a bag member first end and a bag member second end, the bag member second end fixedly mounted within the tube member cavity spaced from the second end cap, and the flexible bag member including flexible bag member opening at a first end of the flexible bag member, the flexible bag member opening defined within an elastomeric ring at the bag member first end to permit projection of the bag member in surrounding relationship relative to the sleeping bag when the sleeping bag is in a furled relationship about the tube member.

4. An apparatus as set forth in claim 3 further including a support assembly, wherein the support assembly includes a support tube, the support tube includes a receiving socket at an upper end of the support tube, with the receiving socket including a receiving socket bottom wall, and the tube member first end cap received within the receiving socket against the receiving socket bottom wall, and the support tube lower end includes a plurality of support legs radially projecting from the lower end, wherein the support legs are orthogonally oriented relative to the support tube.

* * * * *